United States Patent [19]

Brinkel et al.

[11] Patent Number: 4,580,590

[45] Date of Patent: Apr. 8, 1986

[54] AUTOMATIC AIR VALVE ASSEMBLY

[75] Inventors: Edwin P. Brinkel, Royal Oak; James A. LaBelle, Troy; L. Douglas Blatt, Grosse Pointe Farms, all of Mich.

[73] Assignee: ISI Fluid Power, Inc., Fraser, Mich.

[21] Appl. No.: 650,103

[22] Filed: Sep. 13, 1984

[51] Int. Cl.[4] ..... F16K 31/122

[52] U.S. Cl. ..... 137/106; 137/624.14

[58] Field of Search ..... 137/106, 624.14; 91/306, 305, 308

[56] References Cited

U.S. PATENT DOCUMENTS

| | | | |
|---|---|---|---|
| 2,698,517 | 1/1955 | Witt | 91/308 X |
| 2,711,717 | 6/1955 | Stacey | 91/308 X |
| 3,385,166 | 5/1968 | Kroffke | 137/624.14 X |
| 4,064,898 | 12/1977 | Petersen | 137/624.14 X |
| 4,462,418 | 7/1984 | Xander | 137/624.14 X |

*Primary Examiner*—Alan Cohan

*Attorney, Agent, or Firm*—Cullen, Sloman, Cantor, Grauer, Scott, & Rutherford

[57] ABSTRACT

An automatic air valve assembly for alternately delivering pressurized air to one of a pair of control ports of a reciprocal power unit comprises a valve body having a bore, a plurality of inlet, cylinder, and exhaust ports, with the inlet port adapted for connection to a pressurized air supply, and a valve spool movable between a pair of control positions. A pair of pilot valves are mounted upon the ends of the valve body to move the spool between its control positions. Each pilot valve is connected to a cylinder port and has a normally closed air signal port connected to opposite ends of the valve body respectively whereby a build up of pressure at one cylinder port momentarily moves a spring biased spool in one pilot valve to open its signal port, the spool in the valve body continuously and automatically oscillating.

2 Claims, 2 Drawing Figures

AUTOMATIC AIR VALVE ASSEMBLY

This invention relates to shiftable mechanisms and more particularly to devices which are alternately actuated between two positions in response to momentary signals.

BACKGROUND OF THE INVENTION

Heretofore in shiftable mechanisms and particularily control valves which require alternate actuation between two positions, there has been necessitated electrical operated pilot valves and related pressure sensing equipment for shifting the spool of a valve between two extreme positions. This was for controlling the flow of pressure fluids, for example, from an inlet port to one of a pair of cylinder or outlet ports. The use of electrical operated pilot valves increased manufacturing costs as well as maintenance problems.

Heretofore in employing electrically operated pilot valves operating a shiftable mechanisim such as a valve spool between one of a pair of positions of control, such electrical control mechanisms had to be of such size as to be effective in controlling reciprocal movements of the shiftable spool or valve element.

Increased space was needed and a considerable number of additional parts were required to be stocked for the assembly of such electrically operated pilot valves.

SUMMARY OF THE INVENTION

It is an important object of the present invention to provide automatic shiftable mechanism which eliminates the use of electrical operated pilot valves and their related pressure sensing equipment. This reduces manufacturing costs and maintanence problems.

It is a further object to provide an improved shiftable mechanism which may be fabricated of relatively small size and may be so shaped as to be capable of assembly at an integral part of a unit which is being controlled. This results in a saving of space and a reduction of the number of the parts which must be stocked in an industrial establishment for the assembly of such mechanisms.

It is a feature of the present invention to provide an improved shiftable mechanism which is entirely operated and which may be used to control different types of processes either singularly or in sequence.

Another feature is to provide in conjunction with a shiftable mechanism, such as a valve with a spool shiftable between a pair of control positions, a pair of pilot valves connected to opposite ends of the valve body, having a pneumatic connection to the respective cylinder ports, wherein upon a rise in pressure at one or the other of such cylinder ports the relevant adjacent pilot valve will be activated providing such flow of air as will automatically shift the valve spool from one position to its second position. This feature further includes functioning of a second pilot valve so that when there is a build up of pressure in the corresponding other cylinder port air under pressure is delivered to the second pilot valve for delivery to the main valve for shifting a spool back to its original position.

An important feature employs pilot valves where movement of the shiftable spool is automatic and does not require any outside forces for effecting continued intermittent and reciprocal movements of the valve spool of a control valve. Pressurized air is alternately delivered to one of a pair of cylinder ports and to opposite ends of a pneumatic cylinder, for illustration.

As a further feature, in the event the spool becomes centered blocking off all flow of pressurized air through the respective ports thereof, there is provided an impulse valve which responds to line pressure in such a fashion as to move the shiftable mechanism to one of its two positions of control, and wherein thereafter the respective pilot valves take over to operate the shiftable valve mechanism continuously and intermittently.

These and other objects and features will be seen from the following specification and claims in conjunction with the appended drawings.

THE DRAWINGS

Figure 1:
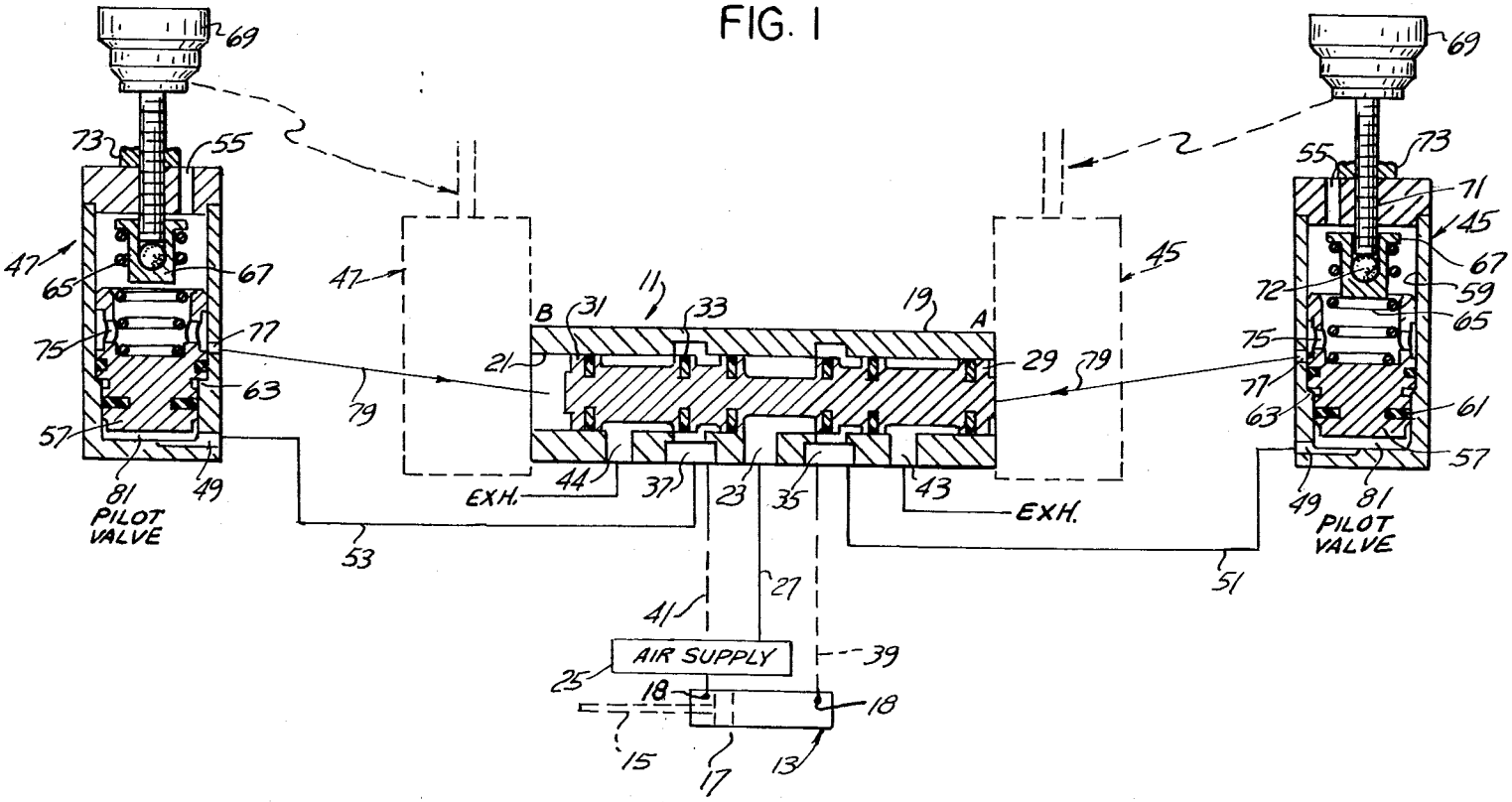
FIG. 1 is a schematic sectional view of the present automatic air valve assembly and illustrating the pneumatic connections between the respective ports and pilot valves.

It will be understood that the above drawings illustrate merely preferred embodiments of the invention and that other embodiments are contemplated within the scope of claims hereafter set forth.

DETAILED DESCRIPTION OF AN EMBODIMENT OF THE INVENTION

The present automatic air valve assembly or control valve 11 is sometimes referred to as a shiftable mechanism. The shiftable mechanism is connected to the unit 13 to be controlled or alternately actuated, such as the pneumatic cylinder 17 having a reciprocal piston rod 15 and a pair of control ports 18.

The present shiftable mechanism or automatic air valve assembly includes valve body 19 having a cylindrical bore 21, and air inlet port 23 connected to the pressurized air supply 25, schematically shown, by conduit 27.

Spool 29 of general cylindrical shape having conventional longitudinally spaced annular lands 31 and corresponding annular seals 33 regulates the flow of pressurized air from inlet port 23. Pressurized air is alternately fed through either of the cylinder ports 35 and 37, depending upon the positioning of valve spool 29, in one of the pair of extreme control positions designated at A and B in FIG. 1.

In the illustrative embodiment cylinder port 35 connected to one end of pneumatic cylinder 17 by a conduit 39. The other cylinder port 37 is connected to the opposite end of pneumatic cylinder 17 by conduit 41, schematically shown.

Valve body 19 includes adjacent its opposite ends a pair of exhaust ports 43 and 44 which are adapted to communicate with atmosphere.

A pair of pilot valves 45 and 47 schematically shown spaced from opposite ends of valve body 19 for clarity of illustration of the pneumatic diagram, are actually secured upon opposite ends of valve body 19, as shown by the dash lines 45 and 47.

Each of the pilot valves 45 and 47 includes an inlet port 49 which is connected by the control pipes 51 and 53 to the corresponding cylinder ports 35 and 37. Each of the pilot valves are vented at 55.

Piston 57 is reciprocally positioned within bore 59 suitably sealed therein at 61 and has a first lowermost position bearing against piston stop 63. Said piston is biased to the position shown in FIG. 1 by the coiled compression spring 65 which at one end extends down into the piston 57, and at its opposite end is adjustably supported by spring retainer 67.

Adjusting screw 69 having a suitable handle is axially threaded at 71 through an upper portion of pilot valve 45 and extends down into and operatively engages a ball 72 upon the interior of retainer 67.

Accordingly, the tension within coiled spring 65 may be regulated and preset for a particular pressure, after which the lock nut 73 may be threaded down upon adjusting screw into operative engagement with pilot valve 45 or 47.

Each pilot valve includes an exhaust port 75 in communication with air signal port 77 which is connected by conduit 79 or other fitting to the bore 21 of valve body 19 for application of pressurized air to one end of spool 29.

The conduit 79 is merely a schematic indication that pressurized air from the signal port 77 is transmitted to and operatively engages the corresponding end of spool 29 in valve body 19.

Inlet port 49 is in communication with pressure chamber 81 at the lower end of the pilot valve in communication with piston 57.

The present shiftable mechanism, namely the automatic air valve assembly 11, has a four-way five ported valve body 19. Spool 29 supported and sealed therein is shiftable between the extreme outward positions A and B when the cylinder port pressure directed to either of the pipes 51 or 53 reaches a preset adjustable pressure corresponding to the adjustment of compression in the respective spring 65. The two pilot valves 45 and 47 are mounted on each end of valve body 19 for causing the spool 29 to oscillate between the two positions shown.

Each pilot valve 45, 47 is energized by increasing pressure at one of the cylinder ports 35 and 37. When the preset pressure on the adjacent pilot valve is reached, piston 57 rises under the action of the pressurized air in chamber 81 by a snap action against the spring 65. Thus there is a flow of pressurized air from inlet port 49 through pressure chamber 81 and outwardly of signal port 77 when the piston has been elevated to its extreme uppermost position. Pressured air passes through the conduit 79 or other connection from signal port 77 to valve bore 21 adjacent the right end of spool 29. This causes the spool to merely shift to the B position, FIG. 1, where it is stopped by the adjacent pilot valve 47, shown in dash lines. With this shift of spool 29 the process starts all over again at pilot valve 47. Here again with the spool 29 in the B position pressurized air at inlet port 23 passes through cylinder port 37 and is directed by conduit 41 to the opposite end of the unit to be controlled, as for example cylinder assembly 13–15.

When pressure builds up at the cylinder port 37, due to piston rod 15 reaching the end of its inward stroke within cylinder 17, pressure within the corresponding cylinder port 37 is transmitted through conduit 53 to the corresponding inlet port 49 of pilot valve 47.

When this pressure builds up to the preset spring pressure upon the corresponding piston 57 the piston 57 rises against the action of spring 65 until pressurized air within pressure chamber 81 has moved the piston 57 to its uppermost position. This permits flow of air from chamber 81 out through the air signal port 77 and through the conduit 79, schematically shown, and delivers pressurized air to the opposite end of bore 21 of valve body 19. This will automatically shift spool 29 from the B position to the A position. Thus the alternate operation of the respective pilot valves 45 and 47 cause a continuous oscilation of valve spool 29 between A and B positions. This results in the alternate pressurizing of the corresponding cylinder ports 35 and 37 to opposite ends of the control unit or cylinder assembly 17 FIG. 1.

As viewed from FIG. 1 with cylinder port 35 pressurized and with the valve spool 29 in the A position shown, exhaust from conduit 41 from cylinder 17 returns to cylinder port 37 and exhausts to atmosphere through exhaust port 44.

Conversely where the spool 29 is in the B position pressurized air at port 23 goes to cylinder port 37 and through conduit 41 to the far end of cylinder 17. As pressure builds up at cylinder port 37, such as towards the end of the inward stroke of the piston 15, that pressure build up will be transmitted through conduit 53 to inlet port 49 of pilot valve 47.

Figure 2:
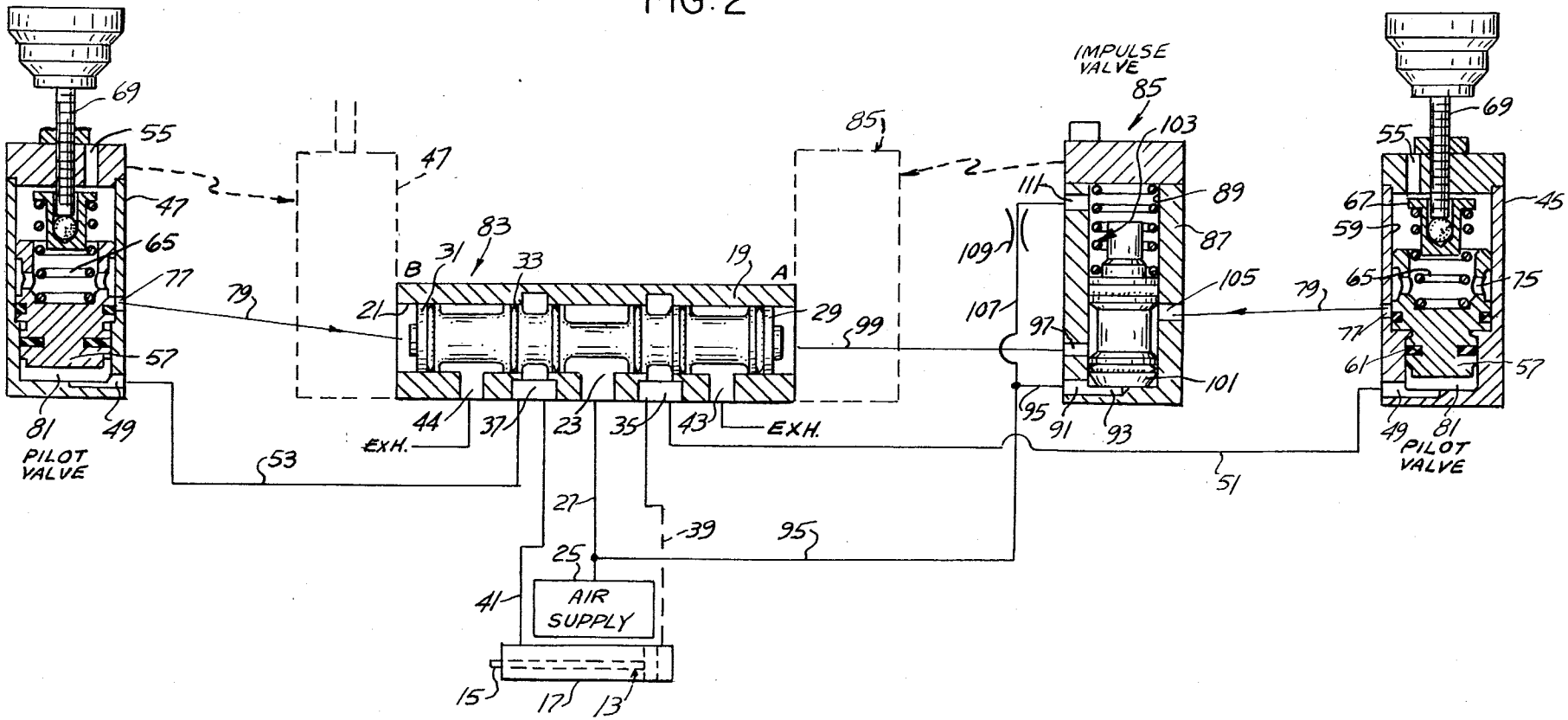
FIG. 2 is a similar view of a modified automatic air control valve assembly incorporating an impulse valve.

It is noted in reviewing FIG. 2 and the respective pilot valves 45 and 47, that with respective pistons 57 in their lowermost positions, there is no flow of pressure fluid through the respective conduits 51 and 53 through either of the inlet ports 49 of the pilot valves.

This corresponds to the position of spool 29 when centered, in FIG. 2, though this could occur by accident.

MODIFIED AUTOMATIC AIR VALVE ASSEMBLY

A modified air valve assembly 83 is shown in FIG. 2 substantially the same construction in most respects as the automatic air valve assembly 11 of FIG. 1.

The single exception is that there is employed additionally an impulse valve 85 mounted upon one end of the body 19 and interposed between the valve body and the adjacent pilot valve 45. The respective pilot valves 45 and 47 of FIG. 2 and the corresponding impulse valve 85 shown spaced apart schematically from valve body 19, merely to indicate the pneumatic connections between the respective elements. It is contemplated, just as shown in FIG. 1, in use and in operation the respective pilot valve 47 engages one end of the valve body 19 and the repective impluse valve 85 engages the other end of the valve body 19. The outermost pilot valve 45 shown in FIG. 2 may be closely adjacent or against the impulse valve 85, or suitably connected thereto by a fitting or other conduit 79. This corresponds to the conduit 79 of FIG. 1 which connects the signal port 77 with one end of valve body 19, FIG. 1.

Impulse valve 85 includes the body 87 in the form of a cylinder havig a cylindrical bore 89, an inlet port 91, pressure chamber 93 and connected thereto pressurized air supply line 95 which joins the main source of presurized air 25.

The body 87 of said impulse valve also includes a second signal port 97 for transmitting a momentary air signal through pressure conduit 99 or fitting to the corresponding bore 21 of valve body 19 FIG. 2. Piston or spool 101 is nested and sealed within bore 89 and normally biased to the position shown by the compression spring 103 within bore 89 which at one end engages the upper end of body 87.

Body 87 also includes a by-pass port 105 which is connected to the signal port 77 of pilot valve 45 as by conduit or fitting 79.

In normal operation the impulse valve 85 is in the inactive position shown with piston 101 in its lowermost position with respect to pressure chamber 93. Thus the air signal from the pilot valve 45 passes directly through the impulse valve through by-pass port 105, through the piston 101 and outlets through the second signal port 97 and fitting 99 for communication with one end of spool 29. This would normally move the spool from the position shown in FIG. 1 to the B position.

Supply line 95 includes a branch pipe 107 which is connected to pressure port 111 in impulse valve body 87, with a suitable restrictor valve 109 interposed. This restricts the flow of pressurized air into pressure port 111.

In normal operation of the automatic air valve assembly such as shown in FIG. 2, it will be the same as above described with respect to FIG. 1. It is only because there may be a situation where the spool 29 has moved accidently or otherwise to a central position, FIG. 2, blocking off all flow of fluid through the respective ports.

In this event the impulse valve 85 operates to correct the situation. The impulse valve piston 101 is normally held by spring 103 to the position shown in FIG. 2. Here the impulse valve acts merely as a by-pass so that the signal air which flows through the signal port 77 of the pilot valve 45 passes directly through impluse valve 85 through the respective ports 105 and 97 and through the fitting or conduit 99 to the bore 21 of valve body 19, to function in the normal manner.

If both of the cylinder ports 35 and 37 become such as by the central positioning of the valve spool 29 FIG. 2, air pressure will build up rapidly in supply line 95. Pressurized air enters inlet port 91, and pressure chamber 93. Sufficient pressurized air moves piston 101 to an uppermost position against the action of spring 103. This opens the pressure line from chamber 93 directly to second signal port 97 through the conduit 99 to the bore 21 of valve body 19. This shifts the valve spool 29 to the B position FIG. 2. Thus at the same time this momentarily blocks the output of pilot valve 45. The flow through fitting 79 to port 105 and thence to second signal port 97 is cut off while piston 101 is in its elevated position.

Since the branch line 107 is delivering the same pressurized air through the restrictor valve 109 to the pressure port 111, there will be a small time delay before pressure builds up on the upper side of impulse valve 85. This pressurized air in cooperation with spring 103 returns the spool 101 to its lowermost position, FIG. 2. The impulse valve 85 then returns to its normal by-pass condition.

Having described our invention, reference should now be had to the following claims.

We claim:

1. An automatic air valve assembly for alternately delivering pressurized air to one of a pair of control ports of a reciprocal power unit comprising a valve body having a bore, an input port adapted for connection to a pressurized air supply and pairs of cylinder and exhaust ports;

a spool slidably positioned and sealed within said body and alternately shiftable between a pair of control positions, for alternately pressurizing one of said cylinder ports and connecting the other cylinder port to an exhaust port;

a pair of pilot valves mounted upon opposite ends of said body, each pilot valve having an inlet port connected to one of said cylinder ports, a normally closed signal port connected to one end of said body and when open adapted for shifting said spool from one control position to its other position, and a spring biased normally retracted piston;

an increase in pressure at one cylinder port to a preset pressure for the adjacent pilot valve causing a momentary shifting of its piston opening said signal port, communicating with its inlet port, a successive increase in pressure at the other cylinder port to a preset pressure for the other adjacent pilot valve causing a momentary shifting of its piston opening the corresponding signal port, shifting said spool to said one position, with said valve spool continuously oscillating between its two pistons;

said control positions of said spool being adjacent the outer ends of said valve body, said spool having a central position closing off all said ports;

an impulse valve interposed between one end of said body and one pilot valve having a bi-pass port communicating with the signal port of said one pilot valve and a second signal port connected to one end of said valve body, and a spring biased normally open and normally retracted spool within said impulse valve permitting communication between said bi-pass port and said second signal port, there being a normally closed inlet port in said impulse valve connected to said pressurized air supply, and adapted on movement of said impulse valve spool for communication with said second signal port, and responsive to a pressure build up whenever the spool in said valve body is in a central fluid cut off position.

2. In the valve assembly of claim 1, there being a second inlet port in said impulse valve connected by a branch pipe to said pressurized air supply normally feeding pressurized air to said impulse valve augmenting the spring bias of said impulse valve spool;

and a restricter valve interposed in said branch pipe delaying pressure build up and permitting a momentary advance of said impulse valve spool for opening said second signal port.

* * * * *